United States Patent [19]

Stuckey, Jr. et al.

[11] 4,451,829

[45] May 29, 1984

[54] CIRCULARLY POLARIZED ANTENNA FORMED OF A SLOTTED CYLINDRICAL DIPOLE

[75] Inventors: Clarence W. Stuckey, Jr., Sepulveda, Calif.; Robert A. Meyers, deceased, late of Riverside, Calif., by Carol Mae Meyers, executrix

[73] Assignee: Lockheed Corporation, Burbank, Calif.

[21] Appl. No.: 51,370

[22] Filed: Jun. 25, 1979

[51] Int. Cl.[3] ..... H01Q 1/28; H01Q 13/12; H01Q 21/29

[52] U.S. Cl. ..... 343/705; 343/730; 343/767

[58] Field of Search ..... 343/705, 708, 727, 730, 343/767, 872

[56] References Cited

U.S. PATENT DOCUMENTS 3,952,310 4/1976 Griffee et al. ..... 343/730

*Primary Examiner*—Eli Lieberman

*Attorney, Agent, or Firm*—Frederic P. Smith

[57] ABSTRACT

An antenna, particularly suitable for two-way communication between a communication satellite and an aircraft in flight, having a circular polarization response, comprising a T-matched dipole element producing a pattern polarized parallel to the axis of the aircraft fuselage, and having a slot therein which is separately excited to produce an E field orthogonally polarized with respect to the pattern of the dipole. By exciting the dipole and the slot in phase quadrature, the combined patterns provide circular polarization as is necessary for satellite communications. The shape of the antenna enclosure has a very low drag and favorable aerodynamic characteristics.

12 Claims, 7 Drawing Figures

CIRCULARLY POLARIZED ANTENNA FORMED OF A SLOTTED CYLINDRICAL DIPOLE

TECHNICAL FIELD

The invention relates to the field of communications and antennas and in particular to a cylindrical slotted antenna having a hemispherical radiation pattern.

BACKGROUND OF PRIOR ART

Heretofore, radio communication with aircraft in flight has been either directly between two aircraft or between an aircraft an a ground station. To provide for such air-to-air and air-to-ground communications there has been provided, heretofore, a variety of effective radio communication antennas. However, with the recent commercial development of communication satellites, it becomes desirable, in certain instances, to communicate directly between an aircraft and a communication satellite located above the flight path of the aircraft. The relative positions of the aircraft and the satellite require a specialized antenna for effective communication, and also may entail mounting the antenna at a location on the aircraft different from that which has been preferred for prior art communication systems. Additionally, optimum communication with a communication satellite requires circular polarization.

A slotted hollow-cylindrical antenna having an essentially circular radiation pattern is disclosed in U.S. Pat. No. 2,510,290. A broadband VHF/UHF antenna having a hemi-spherical radiation pattern suited for airborne satellite communications is disclosed in U.S. Pat. No. 3,811,127. Other slotted cylindrical antennas of the prior art are shown and described in U.S. Pat. No. 2,510,290; U.S. Pat. No. 2,555,443; U.S. Pat. No. 2,600,179; U.S. Pat. No. 2,625,654; U.S. Pat. No. 2,642,529; and U.S. Pat. No. 2,727,232. Other antennas having substantially circular polarized propagation are found in U.S. Pat. No. 2,568,560; U.S. Pat. No. 2,828,413; and U.S. Pat. No. 2,767,395.

BRIEF SUMMARY OF INVENTION

By the present invention there is provided a low-profile, low-drag aircraft antenna for radio communication between the aircraft and a communications satellite. Functionally, the antenna comprises two radiating elements having orthogonally disposed radiation patterns, which elements are excited in phase quadrature to result in circular polarization. The first linear element comprises a dipole which produces a bi-directional pattern polarized parallel to the major axis of the aircraft. Integrally formed with the dipole element is a slotted element which produces a bi-directional pattern polarized parallel to the minor axis of the aircraft (viz., orthogonal with respect to the first element). By exciting the two elements in phase quadrature there is provided the necessary circular polarization desired for satellite communication. A 3 decibel (db) hybrid power splitter is used to provide the 90° phase shift required by the two elements. The antenna is normally mounted on a top fuselage location of the aircraft and is provided with a dielectric cover as may be dictated by aerodynamic considerations.

DETAILED DESCRIPTION OF INVENTION

Figure 1:
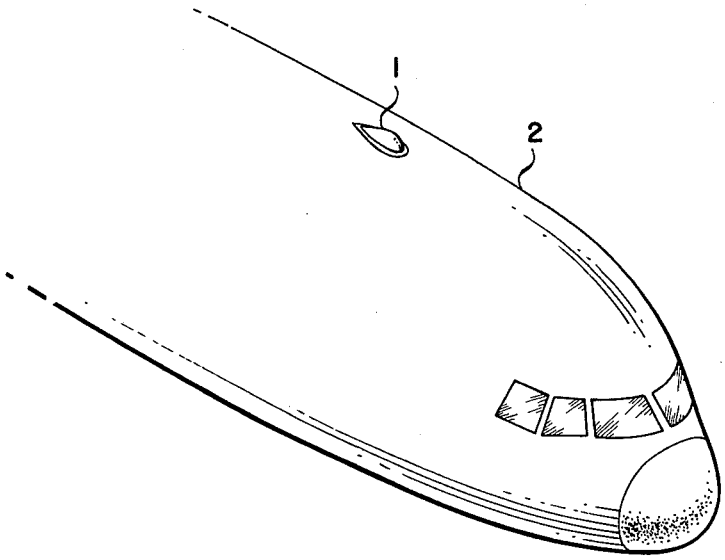
FIG. 1 illustrates the mounting of the antenna of the invention on an aircraft.

Communication satellites typically are located at an altitude greatly above that of aircraft in flight. Therefore, it is preferred that the antenna 1 for communication between an aircraft and a satellite be located on the upper portion of the fuselage 2, as is shown in FIG. 1. The elongated form of the antenna 1 may be aligned to result in minimal aerodynamic drag without adversely affecting its performance, since it is omnidirectional. Directivity is basically in the upper hemisphere thereby reducing the effects of destructive interference caused by multi-path reflections from the earth.

Figure 2:
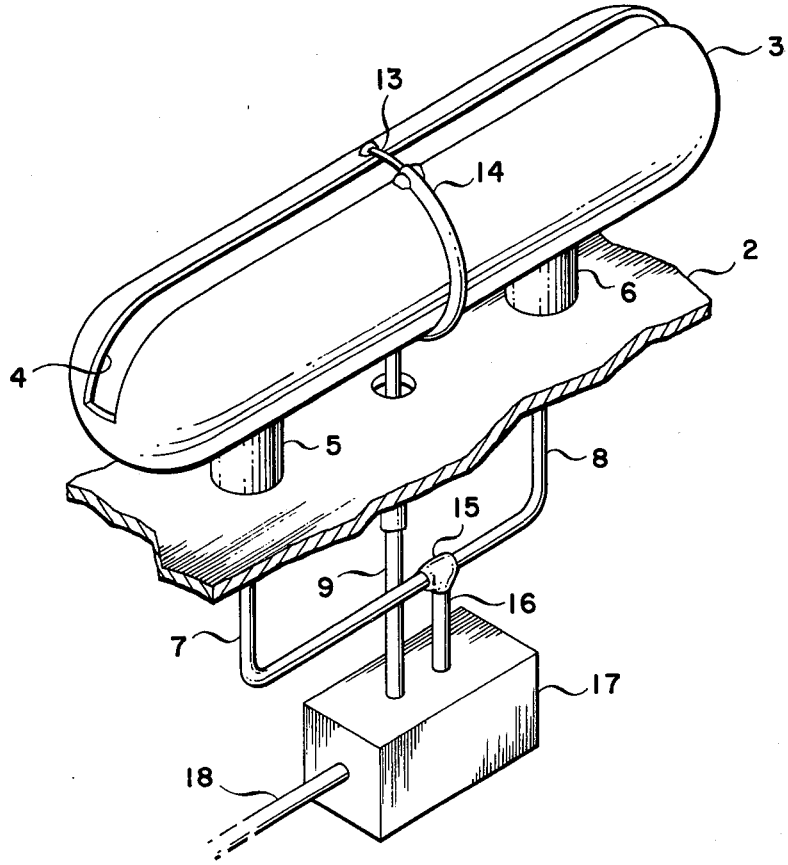
FIG. 2 is a perspective view of a first embodiment of the invention.
Figure 3:
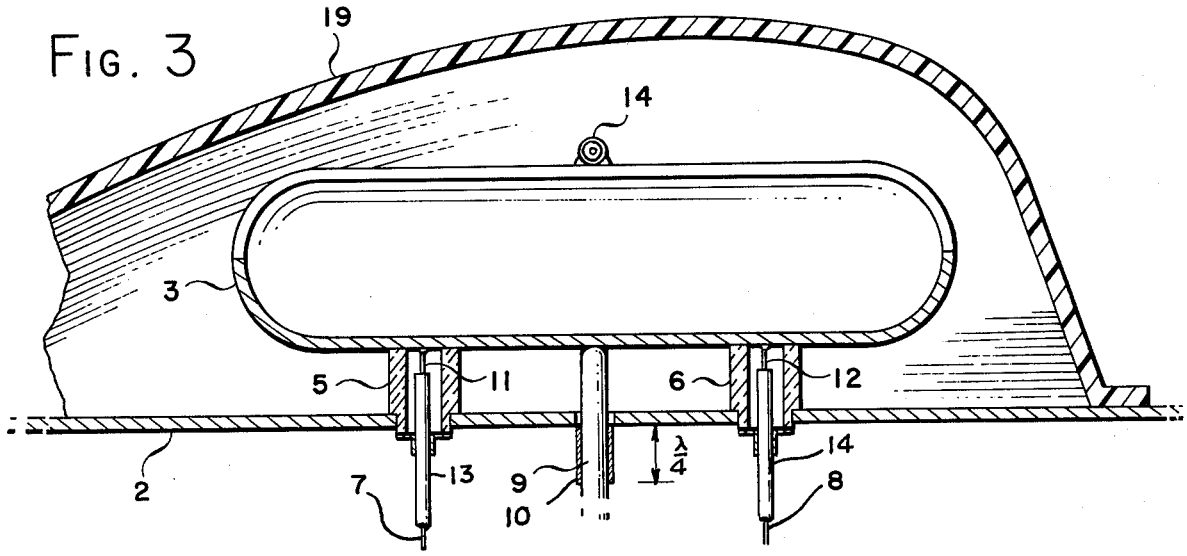
FIG. 3 is an elevational sectional view of the apparatus illustrating its internal construction.

There is shown in FIG. 2 a first embodiment of the invention which comprises an integral tubular conductive member 3 which is hollow and bounded at each end by a hemispherical wall portion. The tubular member 3 is provided with a slot 4 extending through the upper sidewall and extending from end to end. The width of the slot 4 is small by comparison with its length. The member 3 is supported from the outer skin of the aircraft fuselage 2 by a pair of dielectric stand-off insulators 5 and 6. The insulators 5 and 6 are preferably hollow to permit passage of transmission lines 7 and 8 therethrough. This arrangement is shown in greater detail in the sectional elevational view of FIG. 3. The radiating element comprising member 3 is excited via transmission lines 7 and 8, and functions as a T-matched horizontal dipole. The shield conductors 13 and 14, of transmission lines 7 and 8, respectively, are grounded to fuselage 2. The slotted portion (4) of the member (3) is separately driven by transmission line 9 and functions in the manner of a resonant slot antenna.

The transmission lines 7–9, 16 and 18 are preferably, but not necessarily, in the form of coaxial cables having an outer shield conductor and an inner conductor. Such coaxial (concentric) transmission lines are well known to those versed in the art. Inner conductor 11 of line 7 is electrically connected to a point on member 3 spaced away from the longitudinal midpoint thereof. Similarly, center conductor 12 of line 8 is electrically connected to a symmetrically opposite point on member 3 with respect to conductor 11. This feed arrangement conforms to the well-known T-match method of driving a dipole antenna. The phase quadrature drive may be obtained by means of a 3-decibel (db) hybrid power splitter 17 for providing the requisite 90° phase shift. Transmission lines 7 and 8 are joined at "T" junction 15 to a common coaxial line 16 which in turn connects to hybrid splitter 17. Similarly, coaxial line 9 from the slotted portion of the antenna is connected to hybrid splitter 17 via coaxial line 9. A quarter-wave matching stub 10 may be provided for line 9 in order to have the desired high impedance with respect to ground (2). The input to the antenna is applied to coaxial line 18 and emerges from the splitter on lines 9 and 16 as two 90°-shifted signals.

In a typical construction intended for operation in the 1500 megahertz band, the dipole element would be approximately 20 centimeters long and 5 centimeters in diameter. This configuration would provide the desired upper hemispherical coverage. As will be understood by those versed in the art, the antenna may be scaled for other operating frequencies.

Figure 5:
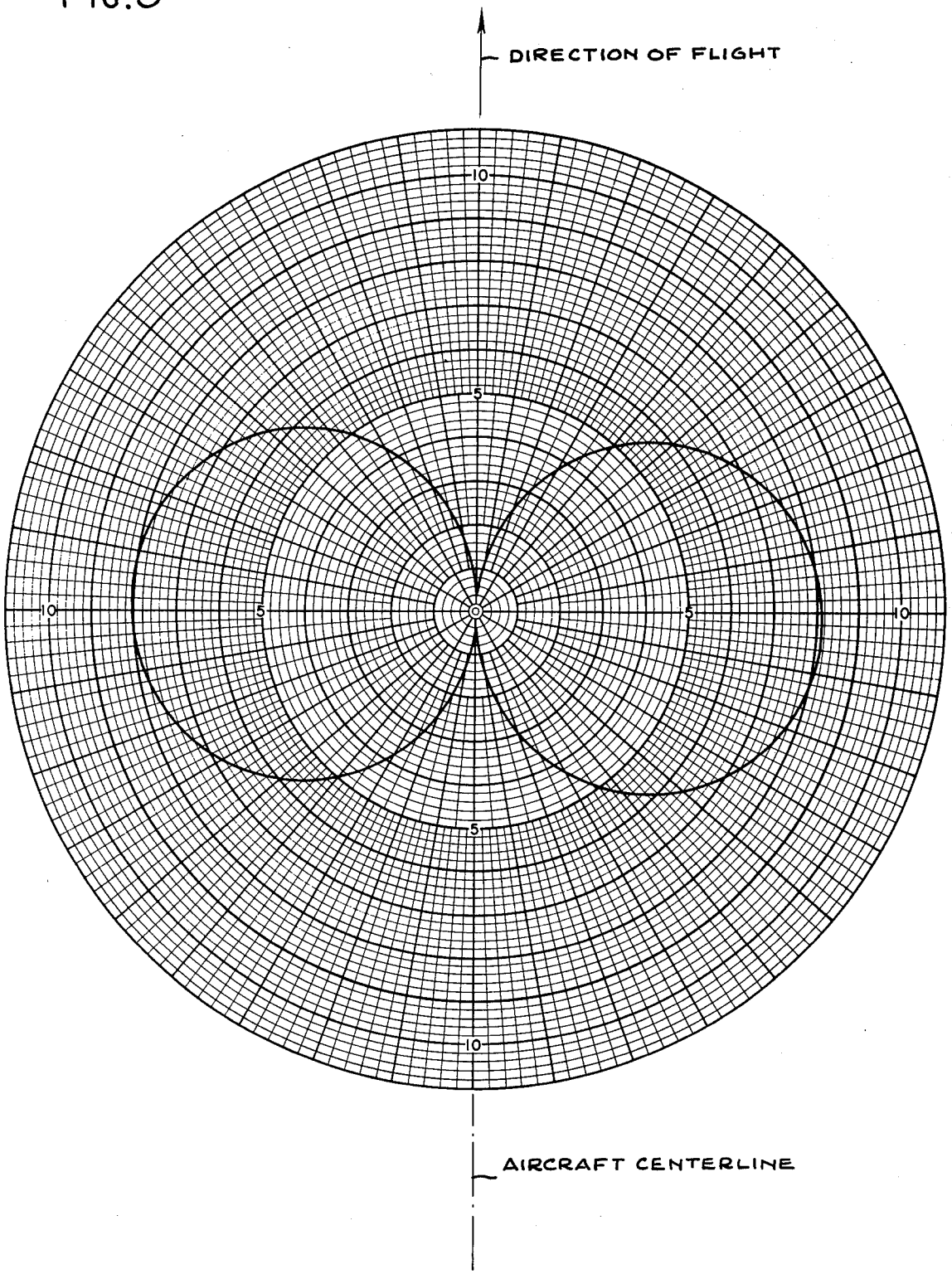
FIG. 5 is a polar plot illustrating the radiation pattern of the dipole element portion of the antenna.

Inasmuch as the dipole portion of the antenna (driven by transmission line7–8) is excited in phase quadrature with the slotted antenna portion of the device (driven by transmission line 9), the overall operating characteristics of the antenna will effectively be the sum of the two effective radiating elements. Inasmuch as the slotted antenna has a conventional "figure eight" radiation pattern having its two lobes extending along the major axis of the dipole (see FIG. 6), and since the dipole has a "figure eight" radiation pattern wherein the two lobes are transverse to the major axis of the slot (see FIG. 5), the resulting pair of figure eight patterns will be additive and yield a circular radiation pattern as shown in FIG. 7.

Figure 6:
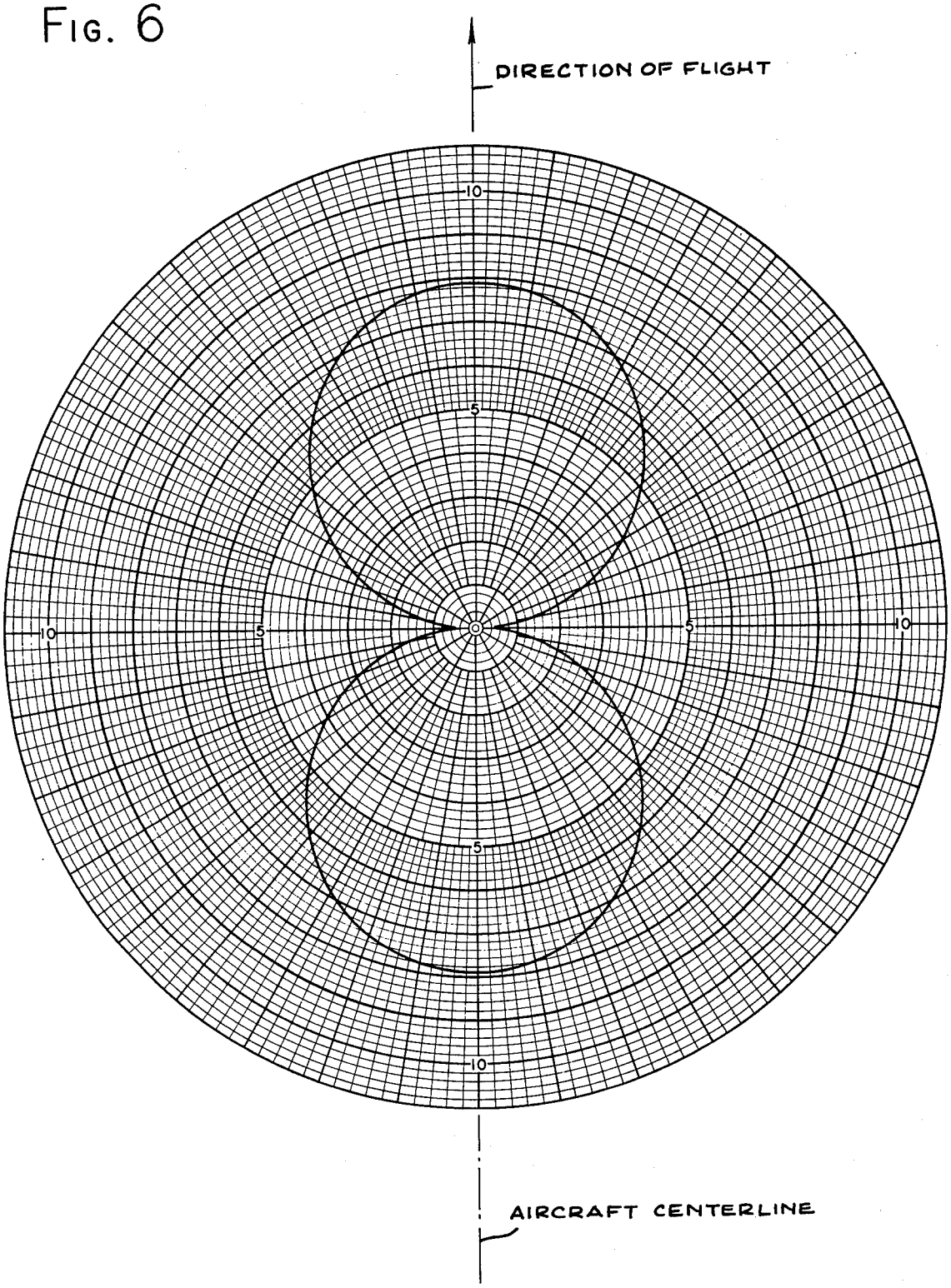
FIG. 6 is a polar plot illustrating the radiation pattern of the slotted element portion of the antenna.
Figure 7:
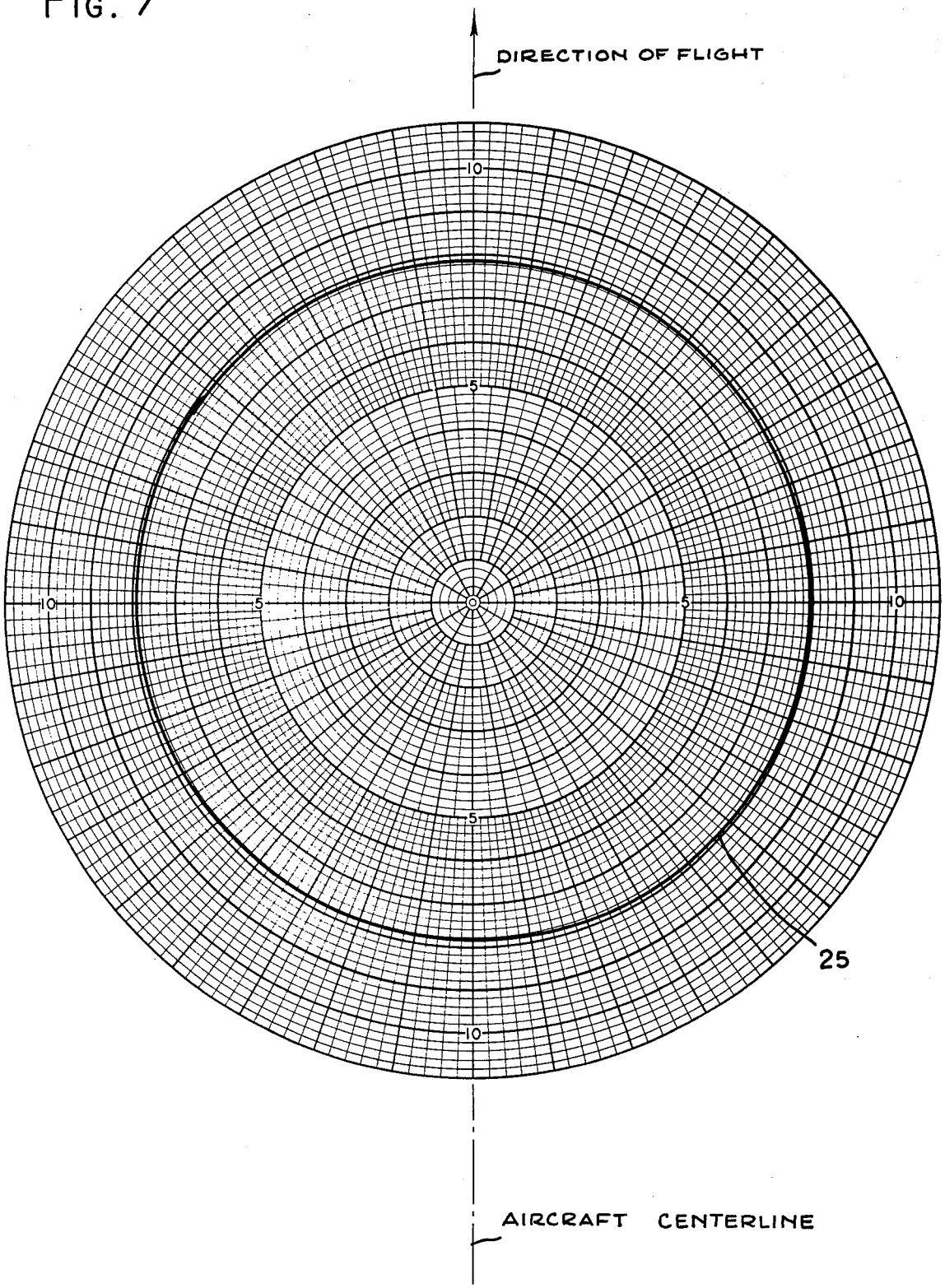
FIG. 7 is a polar plot illustrating the combined patterns of the elements shown in FIGS. 5 and 6.

There is shown in FIG. 6 the overall radiation pattern of the antenna, resulting from the combined outputs of the phase quadrature driven elements. As can be seen, a near perfect circular pattern 25 is obtained, which omnidirectional pattern is required in air-to-air communication systems or aircraft-to-satellite communications.

Figure 4:
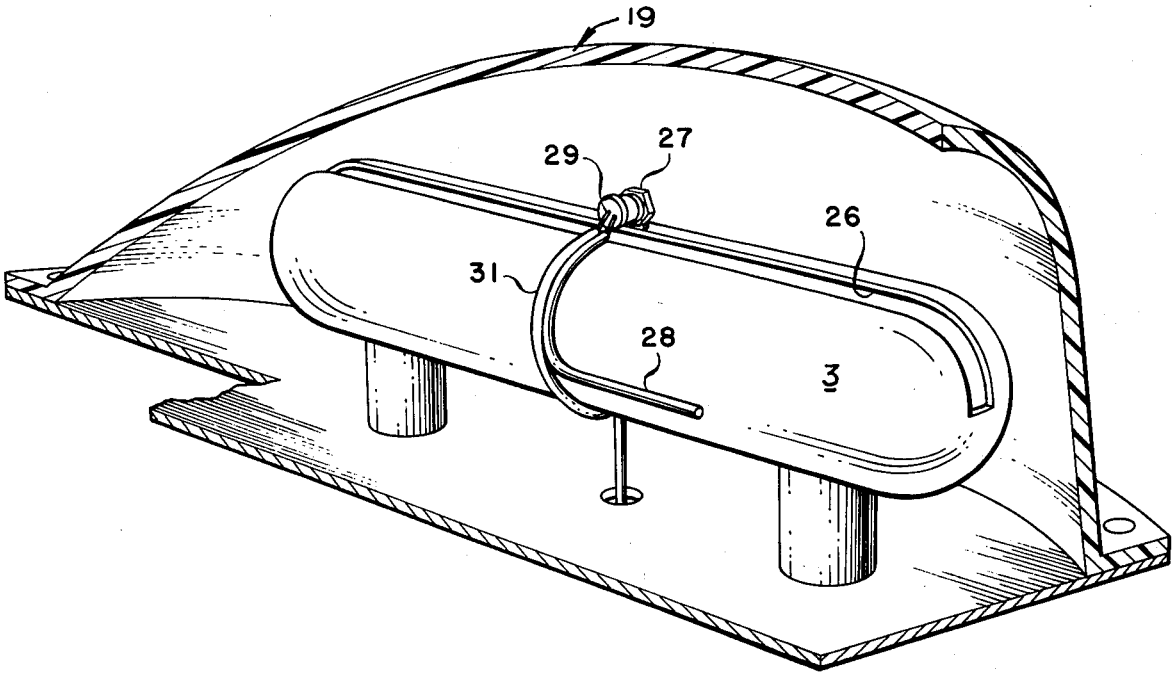
FIG. 4 illustrates a modification of the apparatus of FIG. 2.

There is shown in FIG. 4 an alternate embodiment of the invention in which the slotted element comprising antenna slot 26 is driven via a coupling capacitor 27 and is also provided with a matching stub 28. The interior conductor 29 of the coaxial transmission line 31 is connected to one terminal of the coupling capacitor 27. The shield conductor of the coaxial transmission line 31 is connected to one side of the antenna slot 26. The opposite side of the antenna slot 26 is connected to the remaining terminal of the coupling capacitor 27. The matching stub 28 comprises a short length of coaxial line connected in parallel to the coaxial line 31 at its junction with the first side of the antenna slot 26 and the first terminal of the coupling capacitor 27. The geometry necessary, or alignment of the matching stub 28 may be achieved as is desired, or suitable, for appropriate impedance matching, as will be readily understood by those versed in the art. Also, if desired, components 27–29 and 31 may be installed within member 3.

It is preferred that the antenna be provided with a dielectric cover 19 to provide physical protection, avoid ice build-up, reduce aerodynamic drag and other similar objectives. FIG. 7 shows such a cover (19) partially broken away to reveal the interior and the antenna arrangement. If components 27–29 and 31 are located within the member 3, then the dielectric cover may be made close-fitting to member 3 and preferably have a steamlined blade shape.

While the antenna of the invention has been described in terms of preferred embodiments, it will be recognized by those versed in the art that various modifications may be made therein without departing from the intended scope of the invention.

INDUSTRIAL APPLICATION

The antenna is useful for radio communication between an aircraft and a communications satellite.

It is claimed:

1. An antenna comprising:
a hollow conductive cylinder;
conductive walls enclosing the ends of said cylinder;
means defining a narrow longitudinal slot extending along the length of said cylinder;
means for electrically coupling a first transmission line directly across said slot; and,
means for electrically coupling a second transmission line across the midpoint of the longitudinal axis of said cylinder whereby said cylinder functions as a dipole.

2. An antenna as defined in claim 1 including:
means for driving said first and second transmission lines in phase quadrature.

3. An antenna as defined in claim 2 wherein said driving means comprises a three-decibel directional-coupler power divider.

4. An antenna as defined in claim 1 wherein said first transmission line comprises:
a coaxial cable.

5. An antenna as defined in claim 1 wherein said second transmission line comprises:
a coaxial cable.

6. An antenna as defined in claim 1 wherein said enclosing walls comprise:
outwardly extending hemispherical wall members.

7. An antenna as defined in claim 6 wherein the extremities of said slot extend through a portion of the adjacent hemispherical wall member.

8. An antenna as defined in claim 1 including:
a conductive ground plane; and,
dielectric means mounting said cylinder in spaced-apart relationship with respect to said ground plane.

9. An antenna as defined in claim 8 wherein said dielectric means separates said cylinder from said ground plane by a spacing greater than $\frac{1}{8}$ wavelength at the operating frequency of said antenna.

10. An antenna as defined in claim 1 including:
a shunt stub for matching the impedance of said first transmission line to the slotted portion of said antenna.

11. An antenna as defined in claim 1 including:
impedance matching capacitance means interposed between said first transmission line and one side of said slot.

12. An antenna as defined in claim 1 including:
a dielectric, aerodynamically-faired, enclosure extending over said antenna.

* * * * *